US008207105B2

(12) United States Patent
Panandiker et al.

(10) Patent No.: US 8,207,105 B2
(45) Date of Patent: Jun. 26, 2012

(54) AMINOSILICONE CONTAINING DETERGENT COMPOSITIONS AND METHODS OF USING SAME

(75) Inventors: Rajan Keshav Panandiker, West Chester, OH (US); Kerry Andrew Vetter, Cincinnati, OH (US); Lenae Virginia Johnson, Cincinnati, OH (US); Julie Ann Menkhaus, Cleves, OH (US); Keith Homer Baker, Cincinnati, OH (US); Jennifer Beth Ponder, Cincinnati, OH (US); Peter De Nies, Putte (BE)

(73) Assignee: The Procter and Gamble Company, Cincinnati, OH (US)

( * ) Notice: Subject to any disclaimer, the term of this patent is extended or adjusted under 35 U.S.C. 154(b) by 0 days.

(21) Appl. No.: 13/314,216

(22) Filed: Dec. 8, 2011

(65) Prior Publication Data

US 2012/0083438 A1 Apr. 5, 2012

Related U.S. Application Data

(63) Continuation of application No. 12/827,816, filed on Jun. 30, 2010, now abandoned.

(60) Provisional application No. 61/221,632, filed on Jun. 30, 2009.

(51) Int. Cl.
*C11D 9/36* (2006.01)
*C11D 3/37* (2006.01)

(52) U.S. Cl. ..... 510/343; 510/276; 510/347; 510/351; 510/357; 510/394; 510/426; 510/437; 510/466; 510/470

(58) Field of Classification Search ..... 510/276, 510/343, 347, 351, 357, 394, 426, 437, 466, 510/470
See application file for complete search history.

(56) References Cited

U.S. PATENT DOCUMENTS

| | | | | |
|---|---|---|---|---|
| 3,972,131 | A | 8/1976 | Rudy et al. | |
| 4,911,852 | A | 3/1990 | Coffindaffer et al. | |
| 4,923,623 | A | 5/1990 | Coffindaffer | |
| 4,994,593 | A | 2/1991 | Lin et al. | |
| 5,173,201 | A | 12/1992 | Coffindaffer et al. | |
| 5,723,426 | A | 3/1998 | Zhen et al. | |
| 5,759,208 | A | 6/1998 | Zhen et al. | |
| 6,303,565 | B1 | 10/2001 | Clarke et al. | |
| 6,451,749 | B1 | 9/2002 | Murphy et al. | |
| 6,855,680 | B2 | 2/2005 | Smerznak et al. | |
| 7,033,987 | B2 | 4/2006 | Depoot et al. | |
| 7,056,879 | B2 | 6/2006 | Wang et al. | |
| 7,326,677 | B2 | 2/2008 | Delplancke et al. | |
| 7,335,630 | B2 | 2/2008 | Delplancke et al. | |
| 2006/0205631 | A1 | 9/2006 | Smerznak et al. | |
| 2007/0293414 | A1 * | 12/2007 | Panandiker et al. | 510/515 |
| 2009/0071493 | A1 * | 3/2009 | Nguyen et al. | 132/202 |
| 2010/0056420 | A1 * | 3/2010 | Corona et al. | 510/341 |
| 2010/0061952 | A1 * | 3/2010 | Wells et al. | 424/70.11 |
| 2010/0068156 | A1 * | 3/2010 | Kim | 424/45 |
| 2010/0267601 | A1 * | 10/2010 | Panandiker et al. | 510/276 |
| 2010/0330020 | A1 | 12/2010 | Panandiker et al. | |
| 2010/0331225 | A1 | 12/2010 | Panandiker et al. | |
| 2011/0245137 | A1 | 10/2011 | Wagner et al. | |

FOREIGN PATENT DOCUMENTS

| | | | |
|---|---|---|---|
| EP | 0288137 A2 | | 10/1988 |
| WO | 2011002825 | * | 1/2011 |

OTHER PUBLICATIONS

International Search Report dated, Oct. 27, 2010 containing 105 pages.

* cited by examiner

*Primary Examiner* — Charles Boyer
(74) *Attorney, Agent, or Firm* — Melissa G Krasovec; Leonard W Lewis

(57) ABSTRACT

The instant disclosure relates to cleaning and/or treatment compositions, such as fabric care, hair care and skin care compositions, containing an aminosilicone, one or more anionic surfactants and one or more deposition aids. The disclosed compositions have improved rheology and performance. The disclosed compositions may provide one or more fabric care benefits including, for example, fabric softness and/or an anti-wrinkle benefit. Methods of making and using the compositions are also disclosed.

20 Claims, No Drawings

AMINOSILICONE CONTAINING DETERGENT COMPOSITIONS AND METHODS OF USING SAME

CROSS REFERENCE TO RELATED APPLICATIONS

This application is a Continuation of U.S. application Ser. No. 12/827,816, filed Jun. 30, 2010 now abandoned which claims benefit of and priority to U.S. Provisional Application Ser. No. 61/221,632 filed Jun. 30, 2009.

FIELD OF THE INVENTION

The instant disclosure relates to cleaning and/or treatment compositions comprising aminosilicone to treat surfaces such as fabric, hair, skin and the like, and methods of making and using same.

BACKGROUND OF THE INVENTION

It is highly desired by the consumer that cleaning and/or treatment composition products, such as laundry detergents, shampoos, body-washes and the like deliver additional benefits beyond cleaning. On fabrics, such benefits may include one or more of the following: abrasion resistance, wrinkle removal and/or prevention, pill prevention, anti-shrinkage, anti-static, anti-crease, fabric softness and/or feel, fabric shape retention, suds suppression, decreased residue in the wash or rinse, and/or improved hand feel or texture. On hair and skin, such benefits may include one or more of the following: reduced static and/or static "fly away", reduced friction and/or easier wet-combing, reduced frizziness, shine and/or luster, smoothness, and/or feel.

While silicone containing compositions have been described (see, e.g., U.S. Pat. Nos. 6,451,749; 3,972,131; 4,994,593; 6,303,565 and EP 288137), consumer cleaning and/or treatment composition products containing silicone generally require complex processing to achieve a product having consumer-acceptable viscosity and flow properties. This is due to the fact that, in general, silicones are highly viscous and water-insoluble, and do not readily disperse when added directly into compositions comprising water. As such, silicones must generally be subjected to shear during the manufacturing process to create an emulsion having a uniform particle size prior to incorporation into consumer fabric treatment compositions. This necessitates the extra step of emulsifying the silicone with the aid of an emulsifier and high shear processing equipment. Processing aids, such as structurants and the like, are typically required to stabilize silicones in liquid formulations as silicone droplets tend to float to the top of the formulation, thus causing formulation separation. Such separation results in decreased aesthetic appeal, and in some cases, a product that cannot be used for its intended purpose. In addition to the aforementioned challenges, silicone-containing products also generally require deposition aids to improve deposition of silicones onto surfaces such as fabric, skin and hair. While cationic deposition aid polymers are often used, these polymers often cause formulation problems as a result of to the interaction of the cationic polymer and anionic micelles of the liquid composition. This interaction can result in a product that is "stringy," and can be very difficult and messy to use. Unfortunately the use of any additional ingredients and the expensive equipment required for the additional product transformations increases the cost of manufacture, and ultimately, the cost to the consumer.

Accordingly, there remains the need for stable, affordable consumer products, such as cleaning and/or treatment composition products for fabric, hair and skin, that have desired viscosity and flow properties. The compositions and methods disclosed herein address one or more of the aforementioned needs and, in certain aspects, comprise low level or no external structurant and yet contain aminosilicones in a form that does not lead to creaming and phase separation as well as incorporate aminosilicone directly, as a fluid, without the need for an intermediate step of pre-emulsification.

SUMMARY OF THE INVENTION

The instant disclosure relates to cleaning and/or treatment compositions, such as fabric care, hair care and skin care compositions, comprising aminosilicone, and methods of making and using the same.

In one embodiment, the present disclosure provides a fabric care, hair care or skin care composition comprising an aminosilicone, a deposition aid polymer, an anionic surfactant, optionally a fatty acid and optionally one or more adjunct ingredient, wherein the composition is a liquid laundry detergent or a body-cleansing composition (e.g. shampoo or body-wash). According to these embodiments, the aminosilicone has a structure according to Formula I:

$$[R_1R_2R_3SiO_{1/2}]_n[(R_4Si(X—Z)O_{2/2}]_k[R_4R_4SiO_{2/2}]_m[R_4SiO_{3/2}]_j \quad \text{(Formula I)}$$

wherein $R_1$, $R_2$, $R_3$ and $R_4$ are each independently selected from H, OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, $C_1$-$C_{20}$ alkoxy and combinations thereof; X is a divalent alkylene radical comprising with 2-12 carbon atoms, or independently selected from the group consisting of $—(CH_2)_s—$; $—CH_2—CH(OH)—CH_2—$;

$$—CH_2—\overset{\overset{\displaystyle CH_3}{|}}{CH}—CH_2—;$$

and mixtures thereof, wherein s is on average from about 2 to about 10; Z is selected from the group consisting of $$—\overset{\overset{\displaystyle R_5}{|}}{N}—R_5 \quad \text{and} \quad —\overset{\overset{\displaystyle R_5}{|}}{N}—X—\overset{\overset{\displaystyle R_5}{|}}{N}—R_5;$$

wherein $R_5$ is selected from H, $C_1$-$C_{20}$ alkyl, $C_1$-$C_{20}$ substituted alkyl, and combinations thereof; k is on average from about 3 to about 20; m is on average from about 100 to about 2,000; n is on average from about 2 to about 10, such that n=j+2; and j is on average from about 0 to about 10.

In another embodiment, the present disclosure provides a method of providing a benefit to a fabrichair or skin surface comprising the step of contacting the surface with the composition according to the various embodiments described herein.

Still other embodiments of the present disclosure provide for an article comprising a fabric care, hair care or skin care composition according to the various embodiments described herein.

DETAILED DESCRIPTION OF THE INVENTION

Definitions

As used herein, the term "cleaning and/or treatment composition" includes products for treating fabrics, hard surfaces and any other surfaces in the area of fabric and home care, and biological surfaces such as skin or hair including human skin and hair as well as non-human skin and hair. Examples of such compositions might include granular or powder-form all-purpose or "heavy-duty" washing agents, especially cleaning detergents; liquid, gel or paste-form all-purpose washing agents; liquid fine-fabric detergents; hand dishwashing agents or light duty dishwashing agents, especially those of the high-foaming type; rinse-added agents, liquid cleaning and disinfecting agents, fabric conditioning products including fabric conditioning products including softening and/or freshening that may be in liquid, solid and/or dryer sheet form; as well as cleaning auxiliaries such as bleach additives and "stain-stick" or pre-treat types, substrate-laden products such as dryer added sheets, dry and wetted wipes and pads, nonwoven substrates, sponges; as well as sprays and mists, shampoos and hair-conditioners, and body-washes and bar-soaps. All of such products may be in standard, concentrated or even highly concentrated form even to the extent that such products may in certain aspect be non-aqueous. As used herein, the term "fabric care composition" means a cleaning or treatment composition designed for cleaning, treating or caring for fabrics, such as a laundry detergent, including those set forth above, such as laundry detergents, wash agents, rinse agents, (including solids, granular, powder, liquid, heavy duty liquid (HDL), gel, paste, and unit dose formulations) as well as fabric cleaning auxiliaries. As used herein, the term "hair care composition" means a cleaning or treatment composition designed for cleaning, treating or caring for hair, such as shampoos, conditioners, rinse agents and leave-in treatments intended for use on both humans and animals. As used herein, the term "skin care composition" means a cleaning or treatment composition designed for cleaning, treating or caring for skin, such as bar-soaps, body washes, shaving preparations and post-shave treatments, and leave-on treatments intended for use on both humans and animals.

As used herein, articles such as "a" and "an" when used in a claim, are understood to mean one or more of what is claimed or described.

As used herein, the term "additive" means a composition or material that may be used separately from (but including before, after, or simultaneously with) the cleaning and/or treatment composition to impart a benefit to the treated textile.

As used herein, the term "amine equivalent" refers to the amount of amine present in an aminosilicone, as determined using the method disclosed herein.

The term "cationic polymer" refers to a polymer having a net cationic charge. Polymers containing amine groups or other protonable groups are included in the term "cationic polymers," wherein the polymer is protonated at the pH of the intended use. As used herein, the term "polymer" includes homopolymer, copolymer or terpolymer and polymers with 4 or more type of monomers.

As used herein, the term "fluid" includes liquid, gel, paste and gas product forms.

As used herein, the terms "include", "includes" and "including" are meant to be non-limiting.

As used herein, the term "situs" includes paper products, fabrics, garments, hard surfaces, hair and skin.

As used herein, "substantially free of" a component means that no amount of that component is deliberately incorporated into the composition.

As used herein, the term "external" structurant is a material which has as its primary function that of providing rheological alteration, such as to increase viscosity of a fluid such as a liquid or gel or paste. External structurants may or may not, in and of themselves, provide any significant fabric cleaning or fabric care benefit.

"Liquid cleaning and/or treatment composition" as used herein, refers to compositions that are in a form selected from the group of: "pourable liquid"; "gel"; "cream"; and combinations thereof.

"Pourable liquid" as defined herein refers to a liquid having a viscosity of less than about 2000 mPa*s at 25° C. and a shear rate of 20 $sec^{-1}$. In some embodiments, the viscosity of the pourable liquid may be in the range of from about 200 to about 1000 mPa*s at 25° C. at a shear rate of 20 $sec^{-1}$. In some embodiments, the viscosity of the pourable liquid may be in the range of from about 200 to about 500 mPa*s at 25° C. at a shear rate of 20 $sec^{-1}$.

As used herein, the term "break time" is a measurement of extensional rheology and is the point where the diameter of the string of a composition becomes zero, as measured using the methods described herein. The term is an indicator of the "stringiness" of a product.

"Gel" as defined herein refers to a transparent or translucent liquid having a viscosity of greater than about 2000 mPa*s at 25° C. and at a shear rate of 20 $sec^{-1}$. In some embodiments, the viscosity of the gel may be in the range of from about 3000 to about 10,000 mPa*s at 25° C. at a shear rate of 20 $sec^{-1}$ and greater than about 5000 mPa*s at 25° C. at a shear rate of 0.1 $sec^{-1}$.

"Cream" and "paste" are used interchangeably and as defined herein refer to opaque liquid compositions having a viscosity of greater than about 2000 mPa*s at 25° C. and a shear rate of 20 $sec^{-1}$. In some embodiments, the viscosity of the cream may be in the range of from about 3000 to about 10,000 mPa*s at 25° C. at a shear rate of 20 $sec^{-1}$, or greater than about 5000 mPa*s at 25° C. at a shear rate of 0.1 $sec^{-1}$.

As used herein, an "effective amount" of a material or composition is the amount needed to accomplish an intended purpose, for example, to impart a desired level of fabric care benefit or hair care benefit to a substrate.

As defined herein, "unit dose" or "unitized dose" means an amount of cleaning and/or treatment composition suitable for a single use. For example, the amount of a fabric care composition suitable to treat one load of laundry, such as from about 0.05 g to about 100 g, from 10 g to about 60 g, or from about 20 g to about 40 g. For example, the amount of a hair care composition suitable for a single use will depend upon variable factors such as length of the hair, thickness of the hair, amount of soil present, level of surfactant in the shampoo composition, etc. Generally, an effective amount will be from about 1 to about 40 grams per use, preferably from about 5 g to about 20 g.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Applicants have recognized that the incorporation of select aminosilicone polymers into compositions comprising surfactants at levels required for effective cleansing results in compositions having improved rheology and a minimal need for external structurants or complex manufacturing steps. In addition, the applicants have recognized that incorporation of the aminosilicones described herein decrease the stringiness of the liquid laundry detergent Furthermore, Applicants have recognized that the aminosilicone polymers described herein may provide improved silicone delivery compared to other silicones and aminosilicones known in the art. As such, the compositions and methods described herein address the problem of ineffective deposition of silicone onto surfaces such as fabrics, hair, skin and the like, and the problem of associated cost to use silicone containing agents and the unpleasing rheology of the detergent caused by the incorporation of cationic deposition aid polymer in a liquid cleaning and/or treatment composition containing an anionic surfactant.

Cleaning and/or treatment compositions, such as fabric care compositions, hair care compositions, and the like, comprising an aminosilicone, a deposition aid polymer, and an anionic surfactant are disclosed. The composition may optionally comprise a fatty acid or other adjunct ingredient as described herein.

The cleaning and/or treatment composition may comprise about 0.01% to about 10%, from about 0.3% to about 6%; or from about 1% to about 5% by weight of the composition of an aminosilicone having the structure of Formula I $$[R_1R_2R_3SiO_{1/2}]_n[R_4Si(X—Z)O_{2/2}]_k[R_4R_4SiO_{2/2}]_m[R_4SiO_{3/2}]_j \quad \text{(Formula I)}$$

wherein i) $R_1$, $R_2$, $R_3$ and $R_4$ may each be independently selected from H, $C_1$-$C_{20}$ alkyl, $C_1$-$C_{20}$ substituted alkyl, $C_6$-$C_{20}$ aryl, $C_6$-$C_{20}$ substituted aryl, alkylaryl, $C_1$-$C_{20}$ alkoxy and combinations thereof;

ii) X may comprise a divalent alkylene radical comprising 2-12 carbon atoms, or independently selected from the group consisting of $—(CH_2)_s—$; $—CH_2—CH(OH)—CH_2—$;

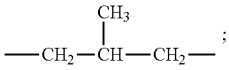

and mixtures thereof, wherein s is on average from about 2 to about 10;

iii) Z may be selected from the group consisting of

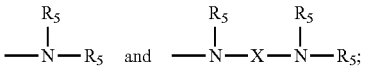

wherein $R_5$ may be selected from the group consisting of H, $C_1$-$C_{20}$ alkyl, $C_1$-$C_{20}$ substituted alkyl, and combinations thereof;

iv) k may be on average from about 3 to about 20, or from about 5 to about 18;

v) m may be on average from about 100 to about 2,000, or from about 150 to about 1,000;

vi) n may be on average from about 2 to about 10, or about 2 to about 4, or 2; and vii) j may be on average from about 0 to about 10, or about 0 to about 4, or 0.

In one aspect, i) $R_1$ may each be independently selected from H, OH, methyl, $C_1$-$C_{20}$ alkoxy, and combinations thereof;

ii) $R_2$, $R_3$ and $R_4$ may be methyl groups;

iii) Z may be selected from

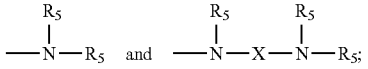

wherein $R_5$ may be selected from the group consisting of H, $C_1$-$C_{20}$ alkyl, and combinations thereof;

iv) X is independently selected from the group consisting of $—(CH_2)_s—$; $—CH_2—CH(OH)—CH_2—$;

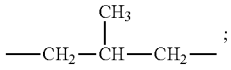

and mixtures thereof, wherein s is on average from about 2 to about 6;

v) k may be on average from about 3 to about 20, or from about 5 to about 18, vi) m may be on average from about 150 to about 1,000;

vii) n may be on average from about 2 to about 6, or 2; such that n=j+2; and viii) j may be from about 0 to about 4, alternatively 0.

As used herein, the nomenclature SiO"n"/2 represents the ratio of oxygen and silicon atoms. For example, $SiO_{1/2}$ means that one oxygen is shared between two Si atoms. Likewise $SiO_{2/2}$ means that two oxygen atoms are shared between two Si atoms and $SiO_{3/2}$ means that three oxygen atoms are shared between two Si atoms.

In another aspect, the aminosilicone may have an amine equivalent of from about 500 g/mol to about 4000 g/mol, or from about 600 g/mol to about 2000 g/mol or even from about 1000 g/mol to about 3000 g/mol.

In one aspect, at least about 70%, or at least about 80%, or at least about 90% of the aminosilicone has a particle size of from about 0.010 microns to about 5 microns, or from about 0.05 microns to about 2 microns.

In one aspect, the composition further includes non-amino-functionalized silicones. The non-amino-functionalized silicone component may comprise volatile, non-volatile silicones or combinations thereof. The non amino-functionalized silicones may comprise a silicone fluid conditioning agent and may also comprise other ingredients, such as a resin to improve silicone fluid deposition efficiency or enhance glossiness of the hair.

Deposition Aid—In one aspect, the cleaning and/or treatment composition may comprise from about 0.01% to about 10%, from about 0.05 to about 5%, or from about 0.15 to about 3% of a deposition aid. Suitable deposition aids are disclosed in, for example, U.S. patent application Ser. No. 12/080,358.

In one aspect, the deposition aid may be a cationic or amphoteric polymer. In one aspect, the deposition aid may be a cationic polymer. Cationic polymers in general and their method of manufacture are known in the literature. In one aspect, the cationic polymer may have a cationic charge density of from about 0.005 to about 23, from about 0.01 to about 12, or from about 0.1 to about 7 milliequivalents/g, at the pH of intended use of the composition. For amine-containing polymers, wherein the charge density depends on the pH of the composition, charge density is measured at the intended use pH of the product. Such pH will generally range from about 2 to about 11, more generally from about 2.5 to about 9.5. Charge density is calculated by dividing the number of net charges per repeating unit by the molecular weight of the repeating unit. The positive charges may be located on the backbone of the polymers and/or the side chains of polymers.

One group of suitable cationic polymers includes those produced by polymerization of ethylenically unsaturated monomers using a suitable initiator or catalyst, such as those disclosed in WO 00/56849 and U.S. Pat. No. 6,642,200.

Suitable polymers may be selected from the group consisting of cationic or amphoteric polysaccharide, polyethylene imine and its derivatives, and a synthetic polymer made by polymerizing one or more cationic monomers selected from the group consisting of N,N-dialkylaminoalkyl acrylate, N,N-dialkylaminoalkyl methacrylate, N,N-dialkylaminoalkyl acrylamide, N,N-dialkylaminoalkylmethacrylamide, quaternized N, N dialkylaminoalkyl acrylate quaternized N,N-dialkylaminoalkyl methacrylate, quaternized N,N-dialkylaminoalkyl acrylamide, quaternized N,N-dialkylaminoalkylmethacrylamide, Methacryloamidopropyl-pentamethyl-1,3-propylene-2-ol-ammonium dichloride, N,N,N,N',N',N",N"-heptamethyl-N"-3-(1-oxo-2-methyl-2-propenyl) aminopropyl-9-oxo-8-azo-decane-1,4,10-triammonium trichloride, vinylamine and its derivatives, allylamine and its derivatives, vinyl imidazole, quaternized vinyl imidazole and diallyl dialkyl ammonium chloride and combinations thereof, and optionally a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glycol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and derivatives, acrylic acid, methacrylic acid, maleic acid, vinyl sulfonic acid, styrene sulfonic acid, acrylamidopropylmethane sulfonic acid (AMPS) and their salts. The polymer may optionally be branched or cross-linked by using branching and crosslinking monomers. Branching and crosslinking monomers include ethylene glycoldiacrylate divinylbenzene, and butadiene. A suitable polyethyleneinine useful herein is that sold under the tradename Lupasol® by BASF, AG, Lugwigschaefen, Germany In another aspect, the treatment composition may comprise an amphoteric deposition aid polymer so long as the polymer possesses a net positive charge. Said polymer may have a cationic charge density of about 0.05 to about 18 milliequivalents/g.

In another aspect, the deposition aid may be selected from the group consisting of cationic polysaccharide, polyethylene imine and its derivatives, poly(acrylamide-co-diallyldimethylammonium chloride), poly(acrylamide-methacrylamidopropyltrimethyl ammonium chloride), poly(acrylamide-co-N,N-dimethyl aminoethyl acrylate) and its quaternized derivatives, poly(acrylamide-co-N,N-dimethyl aminoethyl methacrylate) and its quaternized derivative, poly(hydroxyethylacrylate-co-dimethyl aminoethyl methacrylate), poly (hydroxpropylacrylate-co-dimethyl aminoethyl methacrylate), poly(hydroxpropylacrylate-co-methacrylamidopropyltrimethyl ammonium chloride), poly (acrylamide-co-diallyldimethylammonium chloride-co-acrylic acid), poly(acrylamide-methacrylamidopropyltrimethyl ammonium chloride-co-acrylic acid), poly(diallyldimethyl ammonium chloride), poly(vinylpyrrolidone-co-dimethylaminoethyl methacrylate), poly(ethyl methacrylate-co-quaternized dimethylaminoethyl methacrylate), poly(ethyl methacrylate-co-oleyl methacrylate-co-diethylaminoethyl methacrylate), poly(diallyldimethylammonium chloride-co-acrylic acid), poly(vinyl pyrrolidone-co-quaternized vinyl imidazole) and poly (acrylamide-co-Methacryloamidopropyl-pentamethyl-1,3-propylene-2-ol-ammonium dichloride), Suitable deposition aids include Polyquaternium-1, Polyquaternium-5, Polyquaternium-6, Polyquaternium-7, Polyquaternium-8, Polyquaternium-11, Polyquaternium-14, Polyquaternium-22, Polyquaternium-28, Polyquaternium-30, Polyquaternium-32 and Polyquaternium-33, as named under the International Nomenclature for Cosmetic Ingredients.

In one aspect, the deposition aid may comprise polyethyleneimine or a polyethyleneimine derivative. In another aspect, the deposition aid may comprise a cationic acrylic based polymer. In a further aspect, the deposition aid may comprise a cationic polyacrylamide. In another aspect, the deposition aid may comprise a polymer comprising polyacrylamide and polymethacrylamidoproply trimethylammonium cation. In another aspect, the deposition aid may comprise poly(acrylamide-N-dimethyl aminoethyl acrylate) and/or its quaternized derivatives. In this aspect, the deposition aid may be that sold under the tradename Sedipur®, available from BTC Specialty Chemicals, a BASF Group, Florham Park, N.J. In a yet further aspect, the deposition aid may comprise poly(acrylamide-co-methacrylamidopropyltrimethyl ammonium chloride). In another aspect, the deposition aid may comprise a non-acrylamide based polymer, such as that sold under the tradename Rheovis® CDE, available from Ciba Specialty Chemicals, a BASF group, Florham Park, N.J., or as disclosed in US Published Application No. 2006/0252668.

In another aspect, the deposition aid may be selected from the group consisting of cationic or amphoteric polysaccharides. In one aspect, the deposition aid may be selected from the group consisting of cationic and amphoteric cellulose ethers, cationic or amphoteric galactomannan, cationic guar gum, cationic or amphoteric starch, and combinations thereof Another group of suitable cationic polymers may include alkylamine-epichlorohydrin polymers which are reaction products of amines and oligoamines with epicholorohydrin, for example, those polymers listed in, for example, U.S. Pat. Nos. 6,642,200 and 6,551,986. Examples include dimethylamine-epichlorohydrin-ethylenediamine, available under the trade name Cartafix® CB and Cartafix® TSF from Clariant, Basel, Switzerland.

Another group of suitable synthetic cationic polymers may include polyamidoamine-epichlorohydrin (PAE) resins of polyalkylenepolyamine with polycarboxylic acid. The most common PAE resins are the condensation products of diethylenetriamine with adipic acid followed by a subsequent reaction with epichlorohydrin. They are available from Hercules Inc. of Wilmington Del. under the trade name Kymene™ or from BASF AG (Ludwigshafen, Germany) under the trade name Luresin™. These polymers are described in Wet Strength resins and their applications edited by L. L. Chan, TAPPI Press (1994).

The cationic polymers may contain charge neutralizing anions such that the overall polymer is neutral under ambient conditions. Non-limiting examples of suitable counter ions (in addition to anionic species generated during use) include chloride, bromide, sulfate, methylsulfate, sulfonate, methylsulfonate, carbonate, bicarbonate, formate, acetate, citrate, nitrate, and mixtures thereof.

The weight-average molecular weight of the polymer may be from about 500 to about 5,000,000, or from about 1,000 to about 2,000,000, or from about 2,500 to about 1,500,000 Daltons, as determined by size exclusion chromatography relative to polyethyleneoxide standards with RI detection. In one aspect, the MW of the cationic polymer may be from about 500 to about 37,500 Daltons.

Anionic Surfactant—The liquid cleaning and/or treatment compositions of the present invention may comprise from about 1% to about 80%, or from about 5% to about 50% by weight of anionic surfactant. Useful anionic surfactants can themselves be of several different types. Anionic surfactants of use include those described in U.S. Pat. Nos. 3,664,961, 3,919,678, 4,222,905, 4,239,659, 4,285,841, 6,136,769, 6,020,303, 6,060,443, and in WO 99/05243, 99/05242, 99/05082, 99/05084, 99/05241, 99/07656, 00/23549, and 00/23548. For example, water-soluble salts of the higher fatty acids, i.e., "soaps," are useful anionic surfactants in the present compositions. Non-limiting examples include alkali metal soaps such as the sodium, potassium, ammonium, and alkylolammonium salts of higher fatty acids containing from about 8 to about 24 carbon atoms, or from about 12 to about 18 carbon atoms. Soaps can be made by direct saponification of fats and oils or by the neutralization of free fatty acids. In some embodiments, the sodium and potassium salts of the mixtures of fatty acids derived from coconut oil and tallow, i.e., sodium or potassium tallow and coconut soap, are used.

In one aspect, the cleaning and/or treatment composition may comprise an anionic surfactant selected from the group consisting of $C_8$-$C_{22}$ fatty acid or its salts; $C_{11}$-$C_{18}$ alkyl benzene sulfonates; $C_{10}$-$C_{20}$ branched-chain and random alkyl sulfates; $C_{10}$-$C_{18}$ alkyl ethoxy sulfates, wherein x is from 1-30; mid-chain branched alkyl sulfates; mid-chain branched alkyl alkoxy sulfates; $C_{10}$-$C_{18}$ alkyl alkoxy carboxylates comprising 1-5 ethoxy units; modified alkylbenzene sulfonate; $C_{12}$-$C_{20}$ methyl ester sulfonate; $C_{10}$-$C_{18}$ alpha-olefin sulfonate; $C_6$-$C_{20}$ sulfosuccinates; and combinations thereof.

Additional non-soap anionic surfactants which are suitable for use herein include the water-soluble salts, such as the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Non-limiting examples of this group of synthetic surfactants include: a) the sodium, potassium and ammonium alkyl sulfates, especially those obtained by sulfating the higher alcohols ($C_8$-$C_{18}$ carbon atoms) such as those produced by reducing the glycerides of tallow or coconut oil; b) sodium, potassium and ammonium alkyl polyethoxylate sulfates, particularly those in which the alkyl group contains from 10 to 22, or from 12 to 18 carbon atoms, and wherein the polyethoxylate chain contains from 1 to 15, or 1 to 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. In some aspects, linear straight chain alkylbenzene sulfonates in which the average number of carbon atoms in the alkyl group may be from about 11 to 13 (abbreviated as $C_{11-13}$ LAS) are used. Additional anionic surfactants of use include, but are not limited to: alkane sulfonates, olefin sulfonates, fatty acid ester sulfonates, especially methyl ester sulfonates, alkyl phosphonates, alkyl ether phosphonates, sarcosinates, taurates, alkyl ether carboxylates, fatty acid isothionates, sulfosuccinates and the like.

In some aspects, the anionic surfactants may include $C_8$-$C_{22}$ alkyl sulfates, $C_8$-$C_{22}$ alkyl ethoxy sulfates, $C_8$-$C_{22}$ mid-branched alkyl sulfates, $C_{11}$-$C_{13}$ alkyl benzene sulfonate, $C_{12}$-$C_{20}$ methyl ester sulfonate, C12-C13 fatty acid soap and combination thereof.

In one aspect, the cleaning and/or treatment composition may comprise from about 0.0% to about 0.3%, from about 0.01% to about 0.25%, or from about 0.1% to about 0.2% of an external structurant. Alternatively, the cleaning and/or treatment composition may be substantially free of an external structurant. Here, applicants recognized that the composition may be a liquid cleaning and/or treatment composition such as a liquid detergent composition that may comprise the disclosed aminosilicones without creaming and/or phase separation, and which does not require the intermediate step of pre-emulsification.

In another aspect, the cleaning and/or treatment composition may comprise a softening agent selected from the group consisting of polyglycerol esters, oily sugar derivatives, and wax emulsions.

In another aspect, the cleaning and/or treatment composition may comprise a softening agent selected from the group consisting of polyglycerol esters (PGEs), oily sugar derivatives, and wax emulsions. Suitable PGEs include those disclosed in U.S. PA Ser. No. 61/089,080. Suitable oily sugar derivatives and wax emulsions include those disclosed in published US Published Application No. 2008-0234165 A1.

In another aspect, the cleaning and/or treatment composition may have a percent transmittance of greater than about 45%, greater than about 50%, or greater than about 60%, or greater than about 70% with a maximum percent transmittance of about 100% in the absence of dyes, external structurants or opacifiers.

It is desirable for the cleaning and/or treatment composition such as a liquid detergent compositions to have a break time a viscosity of about 0.001 to about 2 seconds. In some aspects, the break time of the disclosed compositions may be in the range of from about 0.01 sec to about 1 sec. In another aspect, the cleaning and/or treatment composition may have a break time of from about 0.01 sec to about 3 sec, or from about 0.01 sec to about 2 seconds, as measured using the methods disclosed herein.

In another aspect, the cleaning and/or treatment composition may have a % Improvement in Break Time of from about 5% to about 90%, as calculated according to the test methods herein.

In one aspect, the composition provides a benefit to a fabric selected from the group consisting of removal of wrinkles, prevention of wrinkles, fabric softness, improved fabric feel, garment shape retention, garment shape recovery, elasticity, ease-of-ironing, perfume benefits, improved or enhanced color, anti-pilling, color maintenance, color rejuvenation, texture maintenance or combinations thereof. In one aspect, the benefit is an anti-wrinkle benefit.

In one aspect, the composition provides a benefit to hair or skin selected from the group consisting of reduced static and/or static "fly away", reduced friction and/or easier wet-combing, reduced frizziness, increased shine and/or luster, smoothness, improved hair/skin feel, perfume benefits, or combinations thereof.

The compositions disclosed herein may take a variety of forms. In one aspect, the cleaning and/or treatment composition may be a fabric care composition in the form of a liquid detergent. In another aspect, the cleaning and/or treatment composition may be in the form of a laundry additive. In one aspect, the cleaning and/or treatment composition may be a shampoo or body-wash or shampoo/body-wash dual-use product. In one aspect, the composition may be in the form may be in the form of an additive, and may be in concentrated form, comprising from about 0.01% to about 50%, or from about 5% to about 30%, or from about 10% to about 15%, water by weight of the composition. In one aspect, the composition may take the form of a granule detergent. In a further aspect, the composition may be provided as a unit dose.

Adjunct Materials

The following non-limiting list of adjuncts illustrated hereinafter may be suitable for use in the instant compositions and may be desirably incorporated in certain aspects, for example to assist or enhance performance, for treatment of the substrate to be cleaned, or to modify the aesthetics of the composition as is the case with perfumes, colorants, dyes or the like. Said adjuncts may be in addition to the components that are supplied via Applicants' compositions. The precise nature of these additional components, and levels of incorporation thereof, will depend on the physical form of the composition and the nature of the operation for which it is to be used. Suitable adjunct materials may include surfactants, builders, chelating agents, dye transfer inhibiting agents, dispersants, enzymes, and enzyme stabilizers, catalytic materials, bleach activators, polymeric dispersing agents, clay soil removal/anti-redeposition agents, brighteners, suds suppressors, dyes, dispersed particles, other conditioning actives, anti-dandruff agents, humectants, suspending agents, vitamins, additional perfume and perfume delivery systems, structure elasticizing agents, fabric softeners, carriers, hydrotropes, rheology modifiers, water processing aids and/or pigments. In addition to the disclosure below, suitable examples of such other adjuncts and levels of use are found in U.S. Pat. Nos. 5,576,282, 6,306,812 B1 and 6,326,348 B1.

Each adjunct ingredient is not essential to Applicants' compositions. Thus, in certain aspects, Applicants' compositions may not contain one or more of the following adjuncts materials: bleach activators, surfactants, builders, chelating agents, dye transfer inhibiting agents, dispersants, enzymes, and enzyme stabilizers, catalytic metal complexes, polymeric dispersing agents, clay and soil removal/anti-redeposition agents, brighteners, suds suppressors, dyes, dispersed particles, other conditioning actives, anti-dandruff agents, humectants, suspending agents, vitamins, additional perfumes and perfume delivery systems, structure elasticizing agents, fabric softeners, carriers, hydrotropes, processing aids and/or pigments. However, when one or more adjuncts are present, such one or more adjuncts may be present as detailed below:

Surfactants—The compositions may comprise an additional surfactant or surfactant system wherein the surfactant may be selected from nonionic and/or anionic and/or cationic surfactants and/or ampholytic and/or zwitterionic and/or semi-polar nonionic surfactants. The surfactant is typically present at a level of from about 0.1%, from about 1%, or even from about 5% by weight of the cleaning compositions to about 99.9%, to about 80%, to about 35%, or even to about 30% by weight of the cleaning compositions.

Builders—The compositions may comprise one or more detergent builders or builder systems. When present, the compositions will typically comprise at least about 1% builder, or from about 5% or 10% to about 80%, 50%, or even 30% by weight, of said builder. Builders include the alkali metal, ammonium and alkanolammonium salts of polyphosphates, alkali metal silicates, alkaline earth and alkali metal carbonates, aluminosilicate builders polycarboxylate compounds. ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Chelating Agents—The compositions herein may also optionally contain one or more copper, iron and/or manganese chelating agents. If utilized, chelating agents will generally comprise from about 0.1% by weight of the compositions herein to about 15%, or even from about 3.0% to about 15% by weight of the compositions herein.

Dye Transfer Inhibiting Agents—The compositions may include one or more dye transfer inhibiting agents. Suitable polymeric dye transfer inhibiting agents include polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in the compositions herein, the dye transfer inhibiting agents are present at levels from about 0.0001%, from about 0.01%, from about 0.05% by weight of the compositions to about 10%, about 2%, or even about 1% by weight of the compositions.

Dispersants—The compositions may comprise dispersants. Suitable water-soluble organic materials are the homo- or co-polymeric acids or their salts, in which the polycarboxylic acid may comprise at least two carboxyl radicals separated from each other by not more than two carbon atoms.

Enzymes—The compositions may comprise one or more detergent enzymes which provide cleaning performance and/or other benefits. Examples of suitable enzymes include hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination for use in detergents, for example, is a cocktail of conventional applicable enzymes like protease, lipase, cutinase and/or cellulase in conjunction with amylase.

Enzyme Stabilizers—Enzymes for use in compositions, for example, detergents can be stabilized by various techniques. The enzymes employed herein can be stabilized by the presence of water-soluble sources of calcium and/or magnesium ions in the finished compositions that provide such ions to the enzymes.

Catalytic Metal Complexes—Applicants' compositions may include catalytic metal complexes for use in detergents. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methyl-enephosphonic acid) and water-soluble salts thereof. Such catalysts are disclosed in U.S. Pat. No. 4,430,243. If desired, the compositions herein can be catalyzed by means of a manganese compound. Such compounds and levels of use are well known in the art and include, for example, the manganese-based catalysts disclosed in U.S. Pat. No. 5,576,282. Cobalt bleach catalysts useful herein are known, and are described, for example, in U.S. Pat. Nos. 5,597,936 and 5,595,967. Such cobalt catalysts are readily prepared by known procedures, such as taught for example in U.S. Pat. Nos. 5,597,936, and 5,595,967. Compositions herein may also suitably include a transition metal complex of a macropolycyclic rigid ligand—abbreviated as "MRL". As a practical matter, and not by way of limitation, the compositions and processes herein can be adjusted to provide on the order of at least one part per hundred million of the benefit agent MRL species in the aqueous washing medium, and may provide from about 0.005 ppm to about 25 ppm, from about 0.05 ppm to about 10 ppm, or even from about 0.1 ppm to about 5 ppm, of the MRL in the wash liquor. Suitable transition-metals in the instant transition-metal bleach catalyst include manganese, iron and chromium. Suitable MRL's herein are a special type of ultra-rigid ligand that is cross-bridged such as 5,12-diethyl-1,5,8,12-tetraazabicyclo[6.6.2] hexa-decane. Suitable transition metal MRLs may be readily prepared by known procedures, such as taught for example in WO 00/32601, and U.S. Pat. No. 6,225,464.

Article Comprising a Cleaning and/or Treatment Composition

In another aspect, an article comprising a fabric composition as described herein is disclosed. In another aspect, an article comprising a hair or skin care composition as described herein is disclosed.

Methods of Making

The cleaning compositions, such as, but not limited to, the cleaning and/or treatment compositions of the present disclosure can be formulated into any suitable form and prepared by any process chosen by the formulator, non-limiting examples of which are described in U.S. Pat. Nos. 5,879,584; 5,691,297; 5,574,005; 5,569,645; 5,565,422; 5,516,448; 5,489,392; and 5,486,303.

In one aspect, the cleaning compositions disclosed herein may be prepared by combining the components thereof in any convenient order and by mixing, e.g., agitating, the resulting component combination to form a phase stable cleaning composition. In one aspect, a liquid matrix may be formed containing at least a major proportion, or even substantially all, of the liquid components, e.g., nonionic surfactant, the non-surface active liquid carriers and other optional liquid components, with the liquid components being thoroughly admixed by imparting shear agitation to this liquid combination. For example, rapid stirring with a mechanical stirrer may be employed.

Methods of Using

The cleaning and/or treatment compositions disclosed in the present specification may be used to clean or treat a fabric, hair, skin or other situs such as those described herein. Typically at least a portion of the fabric, hair, skin or other situs is contacted with an embodiment of the aforementioned compositions, in neat form or diluted in a liquor, for example, a wash liquor and then the fabric, hair, skin or other situs may be optionally washed and/or rinsed. In one aspect, a fabric, hair, skin or other situs is optionally washed and/or rinsed, contacted with an embodiment of the aforementioned fabric care compositions and then optionally washed and/or rinsed. For purposes of the present disclosure, washing includes but is not limited to, scrubbing, and mechanical agitation. The fabric, hair, skin or other situs may comprise most any material capable of being laundered, washed or treated.

The hair care and skin care compositions disclosed in the present specification may be used to clean or treat hair and/or skin The method for treating hair and/or skin comprising the steps of: a) contacting the hair and/or skin with a conditioning shampoo and/or body-wash composition, the shampoo and/or body-wash containing aminosilicone; and b) rinsing the composition from the hair and/or skin.

The fabric care compositions disclosed in the present specification can be used to form aqueous washing solutions for use in the laundering of fabrics. Generally, an effective amount of such compositions is added to water, such as in a conventional fabric laundering automatic washing machine, to form such aqueous laundering solutions. The aqueous washing solution so formed is then contacted, in one aspect under agitation, with the fabrics to be laundered therewith. An effective amount of the composition, such as the liquid detergent compositions disclosed in the present specification, may be added to water to form aqueous laundering solutions that may comprise from about 250 to about 7,000 ppm or from about 500 to about 3,000 ppm of fabric care composition. In one aspect, the fabric care compositions may be employed as a laundry additive, a pre-treatment composition and/or a post-treatment composition.

Test Methods

Measurement of Transmittance: Transmittance is measured at the wavelength of 650 nm using a SpectraMax M5 Microplate Reader. The path length of 1 cm is used.

Measurement of Viscosity: Viscosity is measured using a TA Instruments AR1000 cone and plate viscometer, manufactured by TA Instruments (New Castle, Del.), using manufacturer-suggested operating conditions at about 25° C.

Measurement of Extensional Rheology: Extensional rheology is measured using a Haake CaBER 1 Extensional Rheometer. A small quantity of sample (25 μL) is placed between two parallel plates (diameter 6 mm) at an initial height of 1 mm The fluid is then exposed to a rapid extensional strain by moving the upper plate upwards to a final height of 6.5 mm at an effective velocity of $2.7e^{-1}$ mm/s The sample rate is 300 Hz, strike time is set at 20.00 ms and the strike distance at 5.41 mm The break time reported (in seconds) is the point where the diameter of the string becomes zero. The average of three readings is reported.

Determination of Amine Equivalent: Amine equivalent is measured by dissolving the aminosilicone of interest in a 1:1 toluene/IPA mixture and titrating 0.1N Hydrochloric acid solution using an auto-titrator to an endpoint of pH=7 Amine equivalent is calculated as molecular weight of the silicone per mole of amine and calculated by the following equation:

$$\text{Amine Equivalent}\left[\frac{g}{mol}\right] = \frac{\text{Sample Amount (g)} \times 10{,}000}{(\text{Hydrochloric Acid Consumption Amount (mL)} \times \text{F (Titer)}}$$

Determination of % Improvement in Break Time: % Improvement in Break Time is calculated using the following equation:

$$100*(Bd-Bs)/(Bd-Bo)$$

wherein Bd is the break time of the Reference 2 composition comprising deposition aid polymer only (without silicone); Bs is break time of a sample composition containing both silicone and deposition aid polymer and Bo is the break time of the Reference 1 composition that does not contain silicone or deposition aid.

EXAMPLES

TABLE Ia

Exemplary Liquid Detergent Fabric Care Compositions and Comparative Reference Formulations.

| Ingredient | Reference 1 Wt % | Reference 2 Wt % | Example 1-5 Wt % |
|---|---|---|---|
| C12-15 alkyl polyethoxylate (1.8) sulfate[1] | 20.1 | 20.1 | 20.1 |
| C12 alkyl trimethyl ammonium chloride[2] | 2.0 | 2.0 | 2.0 |
| 1,2 Propane diol | 3.8 | 3.8 | 3.8 |
| Ethanol | 2.8 | 2.8 | 2.8 |
| Neodol 24-9[3] | 0.30 | 0.30 | 0.30 |
| $C_{12-18}$ Fatty Acid[4] | 2.1 | 2.1 | 2.1 |
| Sodium cumene sulfonate | 1.8 | 1.8 | 1.8 |
| Citric acid | 3.4 | 3.4 | 3.4 |

TABLE Ia-continued

Exemplary Liquid Detergent Fabric Care Compositions and Comparative Reference Formulations.

| Ingredient | Reference 1 Wt % | Reference 2 Wt % | Example 1-5 Wt % |
|---|---|---|---|
| Fluorescent Whitening Agent[6] | 0.08 | 0.08 | 0.08 |
| DTPA | 0.5 | 0.2 | 0.2 |
| Ethoxylated polyamine[7] | 1.2 | 1.2 | 1.2 |
| Deposition Aid: Copolymer of acrylamide and methacrylamidopropyl trimethylammonium chloride[8] | — | 0.3 | 0.3 |
| Aminosilicone of Table 2 | — | — | 6.0 |

TABLE Ia-continued

Exemplary Liquid Detergent Fabric Care Compositions and Comparative Reference Formulations.

| Ingredient | Reference 1 Wt % | Reference 2 Wt % | Example 1-5 Wt % |
|---|---|---|---|
| Water and adjuncts | Balance to 100% | Balance to 100% | Balance to 100% |

Liquid detergent fabric care compositions may be prepared by mixing together the ingredients listed in the proportions shown.

TABLE Ib

Exemplary Hair/Skin Care Composition Formulations.

| Ingredient | Example 6 Wt % |
|---|---|
| Ammonium Laureth Sulfate | 10 |
| Ammonium Lauryl Sulfate | 6 |
| Puresyn 6[10] | 0.25 |
| Cocamide MEA | 0.8 |
| Citric Acid | 0.04 |
| Sodium Citrate Dihydrate | 0.4 |
| Disodium EDTA | 0.1 |
| Kathon CG[11] | 0.0005 |
| Sodium Benzoate | 0.25 |
| Disodium EDTA | 0.1274 |
| Cetyl Alcohol | 0.6 |
| Ethylene Glycol Distearate | 1.5 |
| Polyquaternium-10 | 0.5 |
| Aminofunctional silicone[9] | 2 |

TABLE Ib-continued

Exemplary Hair/Skin Care Composition Formulations.

| Ingredient | Example 6 Wt % |
|---|---|
| Plantaren 2000 N UP[12] | 0.125 |
| Perfume | 0.7 |
| Sodium Chloride | 0-3 |
| Ammonium Xylene sulfonate | 0-3 |
| Water | Balance to 100% |

Hair/skin care compositions may be prepared by mixing together the ingredients listed in the proportions shown.

Table II shows the percent transmittance and break time determination for the reference formulations and examples according to the present disclosure.

TABLE II

% Transmittance and Break Time for the formulations in Table I.

| Example | Silicone[9] | Amine Equivalent | Wt % of Deposition Aid | % Transmittance | Break Time (sec) | % Improvement in Break Tine |
|---|---|---|---|---|---|---|
| Reference 1 | — | — | — | 89.6 | 0.16 | — |
| Reference 2 | — | — | 0.3 | 90.5 | 0.38 | — |
| Example 1 | X22-8699-2[9] | 3200 | 0.3 | 86.2 | 0.31 | 32 |
| Example 2 | X22-8699-5S[9] | 2580 | 0.3 | 50.7 | 0.31 | 32 |
| Example 3 | X22-8699-3S[9] | 1760-1800 | 0.3 | 87.4 | 0.25 | 59 |
| Example 4 | KF-861[9] | 2100-2646 | 0.3 | 76.6 | 0.25 | 59 |
| Example 5 | X-22-3908A Base[9] | 2000 | 0.3 | 90.3 | 0.24 | 64 |
| Comparative Example 1 | DC 1664[9] | 0 | 0.3 | 33.8 | 0.39 | 0 |
| Comparative Example 2 | X22-8699-S[9] | 4300-4350 | 0.3 | Phase separation | Did not test | — |
| Comparative Example 3 | KF-873[9] | 20,000 | 0.3 | 33.9 | 0.40 | 0 |

Liquid detergent fabric care compositions may be prepared by mixing together the ingredients listed in the proportions shown in Table III having a deposition aid comprising a copolymer of acrylamide and methacrylamidopropyl trimethylammonium chloride.

TABLE III

Exemplary Liquid Detergent Fabric Care Compositions and Comparative Reference Formulations.

| Ingredient | Reference 3 Wt % | Reference 4 Wt % | Example 6 Wt % |
|---|---|---|---|
| C12-15 alkyl polyethoxylate (1.8) sulfate[1] | 20.1 | 20.1 | 20.1 |
| C12 alkyl trimethyl ammonium chloride[2] | 2.0 | 2.0 | 2.0 |
| 1,2 Propane diol | 3.8 | 3.8 | 3.8 |
| Ethanol | 2.8 | 2.8 | 2.8 |
| Neodol 24-9[3] | 0.30 | 0.30 | 0.30 |
| $C_{12-18}$ Fatty Acid[4] | 2.1 | 2.1 | 2.1 |
| Sodium cumene sulfonate | 1.8 | 1.8 | 1.8 |
| Citric acid | 3.4 | 3.4 | 3.4 |
| Fluorescent Whitening Agent[6] | 0.08 | 0.08 | 0.08 |
| DTPA | 0.5 | 0.2 | 0.2 |
| Ethoxylated polyamine[7] | 1.2 | 1.2 | 1.2 |
| Copolymer of acrylamide and methacrylamidopropyl trimethylammonium chloride[8] | — | 1.0 | 1.0 |
| X22-3908A Base[9] | 6.0 | — | 6.0 |
| Water and adjuncts | | Balance to 100% | |

Percent transmission and break time were determined for the formulations from Table III. Reference 4 is a negative control, having a Break Time of 0.75 sec. Example 6, containing the disclosed aminosilicone, has an improved Break Time as compared to Reference 4.

TABLE IV

Comparative Data: Percent transmission and Break Time for the formulations of Table III with and without a cationic deposition aid (PAM/MAPTAC).

| Example | % Deposition Aid | Silicone | Break Time (sec) |
|---|---|---|---|
| Reference 3 | — | X22-3908-Base | 0.07 |
| Reference 4 | 1.0 | — | 0.75 |
| Example 6 | 1.0 | X-22-3908A Base | 0.62 |

According to other embodiments, liquid laundry detergent formulations comprising having formulations as described in Table V were prepared. Comparative formulations without the aminosilicone were also prepared. The break time of the formulations with or without aminosilicones as described herein were determined and are presented in Table VI. Shorter break times corresponds to a less stringy formulation.

TABLE V

Exemplary Liquid Detergent Fabric Care Compositions.

| Ingredient | Example 7 Wt % | Example 8 Wt % | Example 9 Wt % | Example 10 Wt % |
|---|---|---|---|---|
| C12-15 alkyl polyethoxylate (1.8) sulfate[1] | 20.1 | 20.1 | 20.1 | 20.1 |
| C12 alkyl trimethyl ammonium chloride[2] | 2.0 | 2.0 | 2.0 | 2.0 |
| 1,2 Propane diol | 3.8 | 3.8 | 3.8 | 3.8 |
| Ethanol | 2.8 | 2.8 | 2.8 | 2.8 |
| Neodol 24-9[3] | 0.30 | 0.30 | 0.30 | 0.30 |
| $C_{12-18}$ Fatty Acid[4] | 2.1 | 2.1 | 2.1 | 2.1 |
| Sodium cumene sulfonate | 1.8 | 1.8 | 1.8 | 1.8 |
| Citric acid | 3.4 | 3.4 | 3.4 | 3.4 |
| Fluorescent Whitening Agent[6] | 0.08 | 0.08 | 0.08 | 0.08 |
| DTPA | 0.5 | 0.5 | 0.2 | 0.2 |
| Ethoxylated polyamine[12] | 1.2 | 1.2 | 1.2 | 1.2 |
| Modified polyethyleneimine | — | 1.0 | — | — |
| Polyvinylformamide | — | — | 1.0 | — |
| Polyquaternium 7 | 1.0 | | | |
| Terpolymer of acrylamide, acrylamidopropyl trimethylammonium chloride and acrylic acid[6] | — | — | — | 1.0 |
| X22-8699-3S | 6.0 | 6.0 | 6.0 | 6.0 |
| Water and adjuncts | | Balance to 100% | | |

TABLE VI

Break Time for the formulations of Table V.

| Example | Break time with silicone (sec) | Break time without silicone (sec) |
|---|---|---|
| Example 7 | 0.85 | 1.19 |
| Example 8 | 0.10 | 0.17 |

TABLE VI-continued

Break Time for the formulations of Table V.

| Example | Break time with silicone (sec) | Break time without silicone (sec) |
|---|---|---|
| Example 9 | 0.17 | 0.25 |
| Example 10 | 3.40 | 3.65 |

[1]Available from Shell Chemicals, Houston, TX

[2]Available from Degussa Corporation, Hopewell, VA.

[3]Available from Shell Chemicals, Houston, TX.

[4]Available from The Procter & Gamble Company, Cincinnati, OH.

[5]Available from Genencor International, South San Francisco, CA.

[6]Available from Ciba Specialty Chemicals, High Point, NC.

[7]Sold under the tradename LUTENSIT ®, available from BASF (Ludwigshafen, Germany) and described in WO 01/05874.

[8]Available from Nalco Chemicals, Naperville, IL.

[9]Aminofunctional silicones, X22-8699-2, X22-8699-5S, X22-8699-3S, KF-861, X-22-3908A Base, X22-8699-S and KF-873 available from Shin-Etsu Silicones, Akron OH; DC 1664 is a polydimethyl siloxane of viscosity 60,000 centistroke available from Dow Corning Corporation, Midland, MI.

[10]Available from ExxonMobil Chemical Company, Houston, TX 77079-1398

[11]Available from Rohm and Haas Company, Inc., Spring House, PA 19477

[12]Available from Cognis Corporation, Care Chemicals, Ambler, PA 19002

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric care composition comprising a. an aminosilicone having the structure of Formula I $$[R_1R_2R_3SiO_{1/2}]_n[(R_4Si(X—Z)O_{2/2}]_k[R_4R_4SiO_{2/2}]_m[R_4SiO_{3/2}]_j \quad \text{(Formula I)}$$

wherein ii. $R_1$, $R_2$, $R_3$ and $R_4$ are each independently selected from H, OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, $C_1$-$C_{20}$ alkoxy and combinations thereof;

iii. X is a divalent alkylene radical comprising with 2-12 carbon atoms, or independently selected from the group consisting of —$(CH_2)$s-; —$CH_2$—CH(OH)—$CH_2$—;

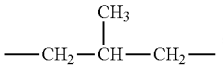

and mixtures thereof, wherein s is on average from about 2 to about 10;

iv. Z is selected from the group consisting of

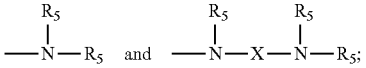

wherein $R_5$ is selected from H, $C_1$-$C_{20}$ alkyl, $C_1$-$C_{20}$ substituted alkyl, and combinations thereof;

v. k is on average from about 3 to about 20;

vi. m is on average from about 100 to about 2,000;

vii. n is on average from about 2 to about 10, such that n=j+2; and viii. j is on average from about 0 to about 10;

b. a cationic polysaccharide deposition aid polymer;

c. an anionic surfactant;

d. optionally, a fatty acid;

e. optionally, an adjunct ingredient f. a fluorescent whitening agent.

2. A fabric care composition according to claim 1 wherein the aminosilicone is present in an amount of from about 0.01% to about 10% by weight of the composition.

3. A fabric care composition according to claim 2 wherein the aminosilicone has an amine equivalent of from about 500 g/mol to about 4000 g/mol.

4. A fabric care composition according to claim 3 having a % transmittance of from about 45% to about 100% in the absence of dyes, external structurants or opacifiers.

5. A fabric care composition according to claim 3 having a break time of from about 0.01 to about 3 seconds.

6. A fabric care composition according to claim 5 having a break time improvement parameter/break time reduction of from about 5% to about 90%.

7. A fabric care composition according to claim 1 wherein i) $R_1$ is each independently selected from H, OH, methyl, $C_1$-$C_{20}$ alkoxy, and combinations thereof;

ii) $R_2$, $R_3$ and $R_4$ are methyl groups;

iii) Z is selected from

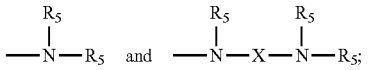

wherein $R_5$ is selected from the group consisting of H, $C_1$-$C_{20}$ alkyl, and combinations thereof;

iv) X is independently selected from the group consisting of —$(CH_2)$s-; —$CH_2$—CH(OH)—$CH_2$—;

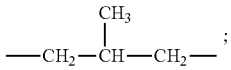

and mixtures thereof, wherein s is on average from about 2 to about 6;

v) k is on average from about 3 to about 20;

vi) m is on average from about 150 to about 1,000;

vii) n is on average from about 2 to about 6; such that n is equal to j+2; and viii) j is from about 0 to about 4.

8. A fabric care composition according to claim 1 wherein at least about 70% of the aminosilicone has a particle size of from about 0.010 microns to about 5 microns.

9. A fabric care composition according to claim 1 wherein said deposition aid has a cationic charge density of 0.005 milliequivalents/g to 23 milliequivalents/g.

10. A fabric care composition according to claim 9 wherein the deposition aid further comprises a cationic or amphoteric polymer selected from the group consisting of polyethylene imine and its derivatives, and a synthetic polymer comprising a cationic monomers selected from the group consisting of N,N-dialkylaminoalkyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl acrylate, quaternized N,N-dialkylaminoalkyl acrylamide, quaternized N,N-dialkylaminoalkylmethacrylamide, vinylamine and its derivatives, allylamine and its derivatives, vinyl imidazole, quaternized vinyl imidazole and diallyl dialkyl ammonium chloride and combinations thereof.

11. A fabric care composition according to claim 9 wherein the deposition aid further comprises a material selected from the group consisting of, poly(acrylamide-co-diallyldimethylammonium chloride), poly(acrylamide-methacrylamidopropyltrimethyl ammonium chloride), poly(acrylamide-co-N,N-dimethyl aminoethyl acrylate) and its quaternized derivatives, poly(acrylamide-co-N,N-dimethyl aminoethyl methacrylate) and its quaternized derivative, poly(hydroxyethylacrylate-co-dimethyl aminoethyl methacrylate), poly (hydroxpropylacrylate-co-dimethyl aminoethyl methacrylate), poly(hydroxpropylacrylate-co-methacrylamidopropyltrimethylammonium chloride), poly (acrylamide-co-diallyldimethylammonium chloride-co-acrylic acid), poly(acrylamide-methacrylamidopropyltrimethyl ammonium chloride-co-acrylic acid), poly(diallyldimethyl ammonium chloride), poly(vinylpyrrolidone-co-dimethylaminoethyl methacrylate), poly(ethyl methacrylate-co-quaternized dimethylaminoethyl methacrylate), poly(ethyl methacrylate-co-oleyl methacrylate-co-diethylaminoethyl methacrylate), poly(diallyldimethylammonium chloride-co-acrylic acid), poly(vinyl pyrrolidone-co-quaternized vinyl imidazole) and poly (acrylamide-co-Methacryloamidopropyl-pentamethyl-1,3-propylene-2-ol-ammonium dichloride).

12. A fabric care composition according to claim 11, wherein the deposition aid comprises a cationic polysaccharide and poly(acrylamide-methacrylamidopropyltrimethyl ammonium chloride).

13. A fabric care composition according to claim 1 wherein the anionic surfactant comprises a material selected from the group consisting of $C_8$-$C_{22}$ fatty acid or its salts; $C_{11}$-$C_{18}$ alkyl benzene sulfonates; $C_{10}$-$C_{20}$ branched-chain and random alkyl sulfates; $C_{10}$-$C_{18}$ alkyl ethoxy sulfates, wherein x comprises from 1-30; mid-chain branched alkyl sulfates; mid-chain branched alkyl alkoxy sulfates; $C_{10}$-$C_{18}$ alkyl alkoxy carboxylates comprising 1-5 ethoxy units; modified alkylbenzene sulfonate; $C_{12}$-$C_{20}$ methyl ester sulfonate; $C_{10}$-$C_{18}$ alpha-olefin sulfonate; $C_6$-$C_{20}$ sulfosuccinates; and combinations thereof.

14. A fabric care composition according to claim 5 further comprising from about 0.01% to about 0.3%, of an external structurant.

15. A fabric care composition according to claim 5 further comprising a softening agent selected from the group consisting of polyglycerol esters, oily sugar derivatives, and wax emulsions.

16. A fabric care composition according to claim 1, said composition being in the form of a granule detergent.

17. A fabric care composition according to claim 1, said composition being in the form of a unit dose.

18. A method of providing a benefit to a fabric comprising the step of contacting a fabric with the composition according to claim 1.

19. A method according to claim 18 wherein the benefit comprises a benefit selected from the group consisting of removal of wrinkles, prevention of wrinkles, fabric softness, improved fabric feel, garment shape retention, garment shape recovery, elasticity, ease-of-ironing, perfume benefits, anti-pilling, color maintenance, color rejuvenation, texture maintenance or combinations thereof.

20. An article comprising a composition according to claim 1.

* * * * *